US009869232B2

(12) United States Patent
Abihana et al.

(10) Patent No.: US 9,869,232 B2
(45) Date of Patent: Jan. 16, 2018

(54) VARIABLE-SPEED PUMP CONTROL FOR ENGINE COOLANT SYSTEM WITH VARIABLE RESTRICTION

(75) Inventors: Osama A. Abihana, Dearborn, MI (US); Scott M. Robichaud, Detroit, MI (US); Scott J. Thompson, Waterford, MI (US)

(73) Assignee: FORD GLOBAL TECHNOLOGIES, LLC, Dearborn, MI (US)

( * ) Notice: Subject to any disclaimer, the term of this patent is extended or adjusted under 35 U.S.C. 154(b) by 934 days.

(21) Appl. No.: 13/534,383

(22) Filed: Jun. 27, 2012

(65) Prior Publication Data

US 2014/0000862 A1 Jan. 2, 2014

(51) Int. Cl.
*F01P 7/16* (2006.01)

(52) U.S. Cl.
CPC ..... *F01P 7/165* (2013.01); *F01P 7/164* (2013.01); *F01P 2060/08* (2013.01)

(58) Field of Classification Search
CPC .... F01P 7/165; F01P 7/164; F01P 3/12; F01P 3/20; F01P 5/10; F01P 2060/08
USPC ..... 123/41.01, 41.04, 41.44, 198 C; 701/36; 165/244; 236/34.5
See application file for complete search history.

(56) References Cited

U.S. PATENT DOCUMENTS

| | | | | |
|---|---|---|---|---|
| 5,215,044 | A * | 6/1993 | Banzhaf et al. | 123/41.29 |
| 7,267,085 | B2 | 9/2007 | Joyce et al. | |
| 7,735,744 | B2 * | 6/2010 | Eisenhour | 237/12.3 B |
| 7,775,268 | B2 * | 8/2010 | Sato et al. | 165/202 |
| 8,387,572 | B2 * | 3/2013 | Ulrey et al. | 123/41.44 |
| 8,430,071 | B2 * | 4/2013 | Carlson et al. | 123/41.44 |
| 2009/0229543 | A1 * | 9/2009 | Suzuki | 123/41.02 |
| 2009/0283604 | A1 | 11/2009 | Martinchick et al. | |
| 2011/0109157 | A1 * | 5/2011 | Tani | 307/9.1 |
| 2011/0120394 | A1 * | 5/2011 | Onozawa et al. | 123/41.1 |
| 2011/0214627 | A1 * | 9/2011 | Nishikawa et al. | 123/41.02 |
| 2011/0226048 | A1 | 9/2011 | Maier | |
| 2012/0132154 | A1 * | 5/2012 | Suzuki et al. | 123/41.02 |
| 2013/0094972 | A1 * | 4/2013 | Smith et al. | 417/32 |

* cited by examiner

*Primary Examiner* — Grant Moubry
(74) *Attorney, Agent, or Firm* — James Dottavio; MacMillan, Sobanski & Todd, LLC

(57) ABSTRACT

A cooling system for an internal combustion engine in a vehicle comprises a variable-speed coolant pump for providing a coolant flow to a plurality of heat-transfer nodes coupled in a coolant loop with the pump. Each node generates a flow rate request based on an operating state of the node. The coolant loop is configurable to a plurality of restriction states. A pump controller receives the flow rate requests, maps each respective flow request to a pump flow rate that would produce the respective pump flow rate request, selects a largest mapped pump flow rate, identifies a restriction state in which the coolant loop is configured, selects a pump speed in response to the selected flow rate and the identified restriction state, and commands operation of the pump to produce the selected pump speed.

8 Claims, 4 Drawing Sheets

| Restriction State #1 | |
|---|---|
| Total Pump Flow | Pump Speed |
| 0.0 | 0.0 |
| 0.5 | $a_1$ |
| 1.0 | $a_2$ |
| 1.5 | $a_3$ |
| 2.0 | $a_4$ |
| 2.5 | $a_5$ |
| 3.0 | $a_6$ |
| 3.5 | $a_7$ |
| ... | ... |

Fig. 5

| Restriction State #2 | |
|---|---|
| Total Pump Flow | Pump Speed |
| 0.0 | 0.0 |
| 0.5 | $b_1$ |
| 1.0 | $b_2$ |
| 1.5 | $b_3$ |
| 2.0 | $b_4$ |
| 2.5 | $b_5$ |
| 3.0 | $b_6$ |
| 3.5 | $b_7$ |
| ... | ... |

Fig. 6

VARIABLE-SPEED PUMP CONTROL FOR ENGINE COOLANT SYSTEM WITH VARIABLE RESTRICTION

CROSS REFERENCE TO RELATED APPLICATIONS

Not Applicable.

STATEMENT REGARDING FEDERALLY SPONSORED RESEARCH

Not Applicable.

BACKGROUND OF THE INVENTION

The present invention relates in general to controlling a variable speed pump for a coolant system of an internal combustion engine, and, more specifically, to minimizing energy consumption for operating the pump while maintaining a minimum required flow for each component connected in the coolant loop.

Because of their high operating temperatures, internal combustion engines require the use of a cooling system to dissipate heat through a radiator. Requirements for the coolant system include rapid warming of a cold engine, removing excess heat from the engine, and supplying heat to components that use the heat such as a heater core for cabin warming, or a heat recovery device of a type that may generate electricity (e.g., exhaust based or manifold based) or that cools exhaust gases for an exhaust gas return (EGR) valve.

A coolant pump (often called the water pump) is typically mechanically driven from the output of the internal combustion engine. A pump has been conventionally sized to give a pumping capacity (i.e., flow rate) sufficient to meet maximum requirements.

Electric pumps have been considered in order to lower the load on the engine at times when no flow or low flow is needed in the coolant loop. Electric pumps are also used on hybrid gas-electric vehicles for the additional reason that a coolant flow may be needed during times that the vehicle is operating off of the battery and the internal combustion engine is off (e.g., to provide cabin heating from an electric heater or to cool a battery or fuel cell).

An electric pump can be operated at variable speeds in order to lower its energy consumption during times that the need for coolant flow is lower. However, prior coolant systems for modulating flow have been complex and expensive (e.g., by requiring additional flow control valves, sensors, and complex control strategies). Copending U.S. patent application Ser. No. 13/534,401, filed Jun. 27, 2012, discloses an invention for reducing power consumption of an electric water heater while maintaining adequate flow for all components in a simple and efficient manner.

The needs of each particular heat-transfer node are determined according to various factors including the amount of heat needing to be lost or gained and the temperature of the coolant. The resulting requests for each node are given in terms of the flow rate of coolant that satisfies the particular needs. However, it is complex and expensive to directly measure the flow rate being delivered by the electric pump. Instead, the typical electric water pump has been controlled based on pump speeds that are usually higher than what is needed but are guaranteed to always meet the minimum requirements. It would be desirable to obtain accurate control of the flow rate delivered by the coolant pump even in the presence of changing flow conditions within the cooling system so that greater energy savings can be realized.

SUMMARY OF THE INVENTION

In one aspect of the invention, vehicle apparatus comprises a variable-speed coolant pump for providing a coolant flow to a plurality of heat-transfer nodes coupled in a coolant loop with the pump. Each node generates a flow rate request based on an operating state of the node. The coolant loop is configurable to a plurality of restriction states. A pump controller receives the flow rate requests, maps each respective flow request to a pump flow rate that would produce the respective pump flow rate request, selects a largest mapped pump flow rate, identifies a restriction state in which the coolant loop is configured, selects a pump speed in response to the selected flow rate and the identified restriction state, and commands operation of the pump to produce the selected pump speed.

BRIEF DESCRIPTION OF THE DRAWINGS

FIGS. 5 and 6 illustrate examples of maps for correlating various levels of total pump flow with the necessary pump speed as determined according to a current restriction state of the coolant loop.

DETAILED DESCRIPTION OF PREFERRED EMBODIMENTS

The main purpose of the electric coolant pump is to deliver necessary coolant flow to meet the heat exchange requirements of all the components (i.e., heat-transfer nodes) connected to the cooling system, including the engine, climate components such as a heater core, and heat recovery components such as an EGR cooler. It is desirable to maximize fuel economy by minimizing cooling system power consumption. Based on the instantaneous operating parameters of the different components, each may request a corresponding flow rate of coolant in order to achieve the desired exchange of heat.

Typical coolant loops exhibit many variations in the interconnection of components and the available flow paths for the coolant. For example, components may be connected in various series or parallel configurations. Furthermore, flow valves may be used which turn the coolant flow off and on to various sections of the coolant loop depending upon the needs of the components. Thus, a heater core isolation valve may prevent the flow of coolant to the heater core when cabin heating is not desired. This reconfiguration of the flow within the coolant loop results in changing flow restrictions, which in turn changes the relationship between pump speed and the flow rate being delivered by the pump. The present invention is directed to accurate control of pump flow rate by dynamically determining the restriction state of the coolant loop.

An advantage of the invention is that a single approach can be used for the pump control regardless of how the components in the system are connected or how the flow restriction changes during operation. All that is required when designing a pump control for a different vehicle is to configure the appropriate mapping relationships between pump speed and flow rate for each of the restriction states.

Figure 1:
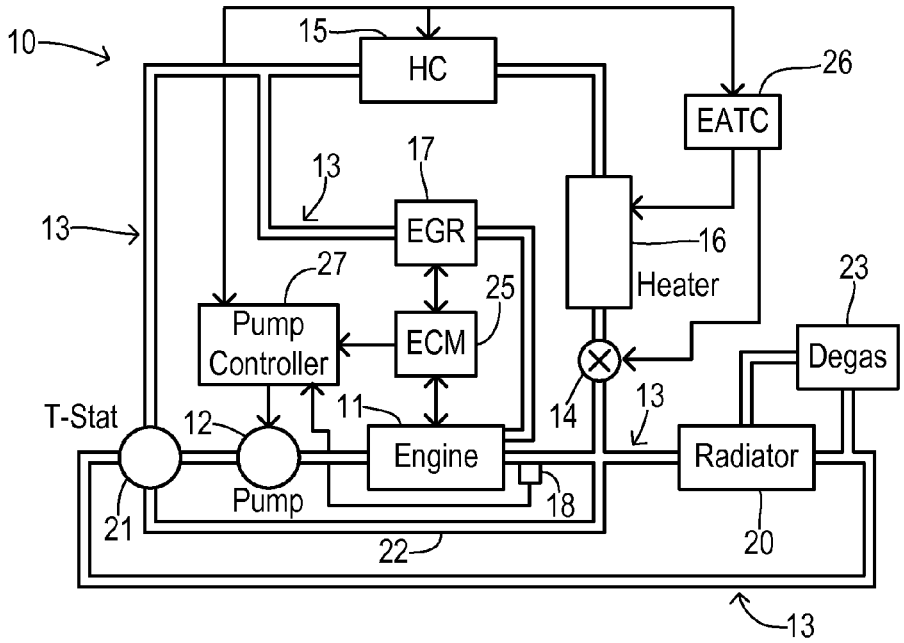
FIG. 1 is a block diagram showing a coolant loop and associated components for a first embodiment adapted for a gas-electric hybrid vehicle.

Referring now to FIG. 1, a vehicle apparatus 10 includes an engine 11 which may be an internal combustion engine mounted in a hybrid electric vehicle, for example. A pump 12 supplies pressurized coolant to circulate through engine 11 and various other components via a plurality of coolant lines 13. In addition to engine 11, other heat-transfer nodes include a heater core 15, auxiliary heater 16, and a heat recovery device in the form of an exhaust gas recirculation (EGR) cooler 17. A heater core isolation valve 14 prevents flow of coolant to heater core 15 except when there is a demand for cabin heating.

A radiator 20 is coupled in the coolant loop between engine 11 and pump 12 via a thermostat 21. When coolant temperature is below a threshold, thermostat 21 blocks radiator flow so that coolant instead follows a bypass 22. Radiator 20 is coupled to a degas system 23 in a conventional manner.

Each heat-transfer node operates in conjunction with a respective controller. Thus, engine 11 is controlled by an engine control module (ECM) 25. An electronic automatic temperature control (EATC) controller 26 operates a climate control system including heater core 15 and auxiliary heater 16 which is connected to battery power (not shown) to supply passenger cabin heat when engine 11 is off. EGR 17 may be controlled by ECM 25 or by a separate controller.

A pump controller 27 is coupled to pump 12 for commanding a pump operating speed in accordance with a desired pump flow rate as determined in accordance with the present invention. Pump controller 27 is coupled to ECM 25 and EATC 26 in order to receive flow rate requests corresponding to the various heat-transfer nodes. Pump controller 27 arbitrates the various requests and activates pump 12 at the lowest appropriate speed (i.e., at the lowest power consumption) for meeting all the current flow requests. An engine coolant temperature (ECT) sensor 18 is coupled to the coolant flow close to engine 11 and provides a signal identifying a current temperature measurement of the coolant to pump controller 27. The ECT signal is also provided to ECM 25, EATC 26, and other controllers as necessary (not shown).

In response to a demand for cabin heating, EATC 26 sends a signal to open heater core isolation valve 14 which is normally closed. The total restriction presented by the coolant loop is altered by the switching of valve 14. Therefore, the pump flow rate changes even if the pump continues to operate at the same speed as before the switching.

Figure 2:
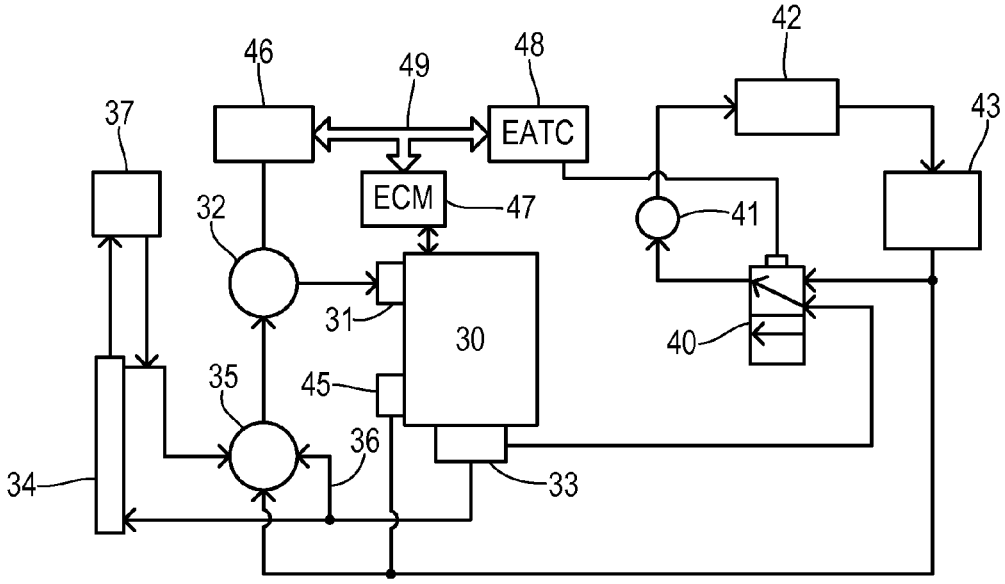
FIG. 2 is a block diagram showing a coolant loop and associated components for a second embodiment adapted for another gas-electric hybrid vehicle.

FIG. 1 represents a system corresponding to a full (standalone) hybrid electric vehicle. Another system architecture of the type used for a plug-in hybrid electric vehicle is shown in FIG. 2. An internal combustion engine 30 has a coolant inlet 31 connected to the outlet of a variable speed pump 32. Engine 30 has a coolant outlet 33 connected to a radiator 34 and a thermostat 35 via a bypass 36. Radiator 34 is connected to a degas bottle 37 and has an outlet connected to thermostat 35.

Outlet 33 is also coupled to one inlet of a valve 40. The outlet of valve 40 is connected to the inlet of an auxiliary pump 41 with its outlet connected to a heater core 42. An electric heater 43 is connected in series with heater core 42 and has its outlet coupled to a second inlet on valve 40 and to thermostat 35. Valve 40 is configurable to provide a flow from engine outlet 33 through heater core 42 during times that engine 30 is operating. When engine 30 is not operating and there is a demand for heat in the passenger cabin, valve 40 is switched to provide flow in an auxiliary loop through auxiliary pump 41, heater core 42, and supplement heater 43.

An EGR 45 receives coolant from engine 30 and then back to an inlet of thermostat 35.

A pump controller 46 is coupled to pump 32. An ECM 47 and an EATC 48 control the engine and climate control systems, respectively, and send corresponding flow rate request messages to pump controller 46 over a multiplex bus 49.

Figure 3:
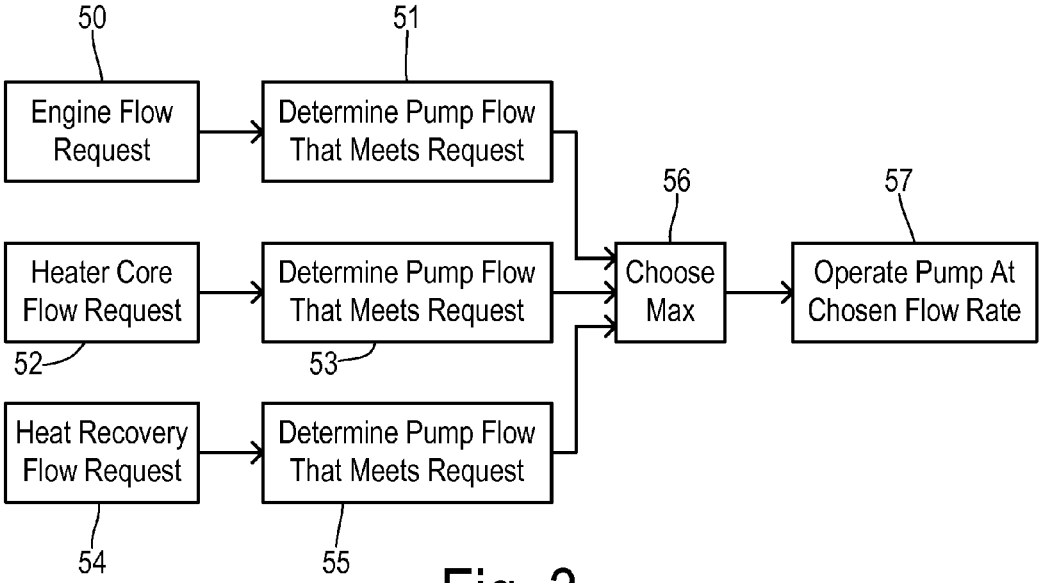
FIG. 3 illustrates a general process of the present invention for determining an optimum flow rate for operating the pump.

The pump controller performs a flow request arbitration as shown in FIG. 3. In block 50, an engine flow request is received that was generated by the engine control system based on the coolant flow required for the engine to meet its current attributes. In block 51, the pump flow rate necessary to meet the engine flow request is determined. Likewise, a heater core flow request is shown in block 52 and the pump flow rate needed to meet the heater core flow request is determined at block 53. If a heat recovery device is present, then a heat recovery flow request is received at block 54 and the pump controller determines the pump flow meeting that request at block 55. In the event that other heat-transfer nodes having unique needs for receiving coolant are present, then similar flow rate requests would be received and similar aggregate pump flow rates would be determined that meet such requests. In block 56, the maximum pump flow rate is determined, and in block 57 the pump is operated at the chosen maximum flow rate.

Each unique vehicle design employs a particular layout of the coolant loop which results in a characteristic distribution of the flow from the water pump. The engine may typically receive 100% of the total flow (i.e., is in series between the pump and all other components), but not necessarily so. The typical coolant loop also includes various parallel branches such as one supplying the heater core and one supplying the EGR. The branches may include respective flow control valves that enable the coolant flow in the branches to be selectively turned on and off. In addition, the thermostat selectively blocks and unblocks the coolant flow to the radiator based on the engine coolant temperature. The instantaneous status of the isolation valves and the thermostat create respective "restriction states" of the coolant loop for which any particular pump speed will produce a different pump flow rate for different restriction states.

Figure 4:
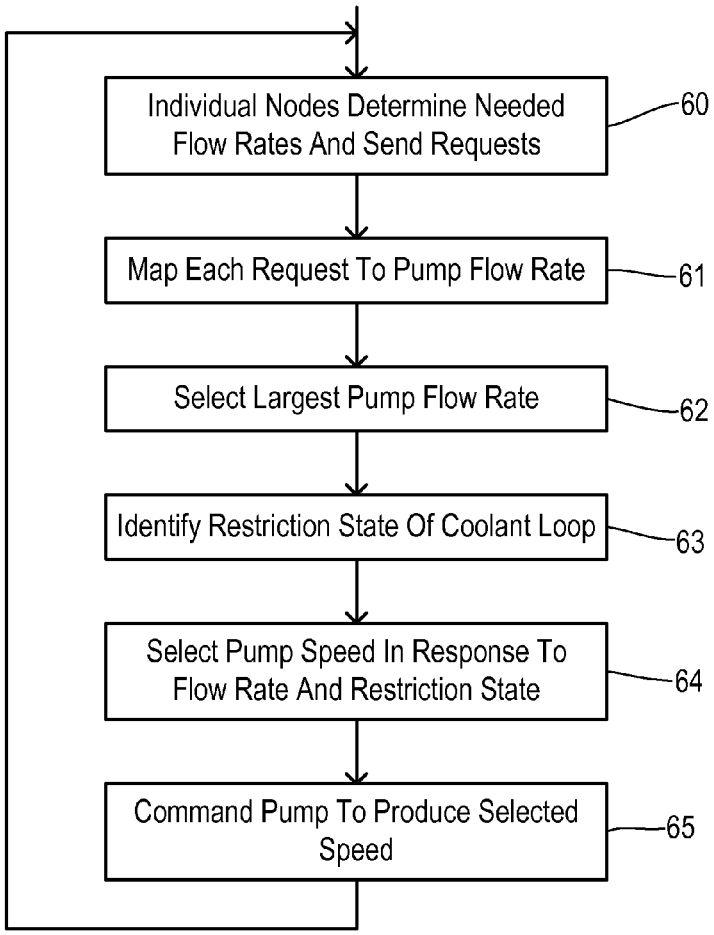
FIG. 4 is a flowchart showing one preferred method for selecting a speed for operating the coolant pump.

When determining a total pump flow rate that produces each respective pump flow rate request, a restriction state of the coolant loop is taken into consideration. FIG. 4 illustrates a general method for accurately controlling pump flow. In step 60, individual nodes determine their needed flow rates and send their respective flow rate requests to the pump controller. In step 61, the pump controller maps each request to a corresponding pump flow rate that would correspond to the requested flow rate based on the way that the total flow distributes to the various components (as described in copending U.S. application Ser. No. (83/236, 190), which is incorporated herein by reference). In step 62, the largest pump flow rate of those determined in step 61 is selected. In step 63, the pump controller identifies the current restriction state of the coolant loop. A pump speed that will produce the selected pump flow rate in view of the identified restriction state is selected in step 64, and the pump is commanded to produce that selected speed in step 65.

The present invention maps each respective pump flow rate to a corresponding pump speed. This relationship may be determined by measurement during operation of a prototype system or by computer simulation. FIG. 5 shows such a map corresponding to a first restriction state, and FIG. 6 shows a map corresponding to a second restriction state. Each map shows a total pump flow in a first column and the pump speed needed to produce the total pump flow in a second column, wherein the values for the pump speed in restriction state #1 are designated $a_1$-$a_7$ and the values for the pump speed in restriction state #2 are designated $b_1$-$b_7$. The resolution and length of the mapping tables in FIGS. 5 and 6 are determined by engineering requirements. Based upon the system design and pump performance, the map data for the tables is built up in advance. During vehicle operation, the pump controller a) arbitrates the component flow requests to determine a minimum pump flow rate that satisfies all the requests, b) identifies the variable restriction or restriction state, c) selects a pump speed in response to the arbitrated flow rate and the identified variable restriction, and d) commands operation of the pump to produce the selected pump speed.

Figure 7:
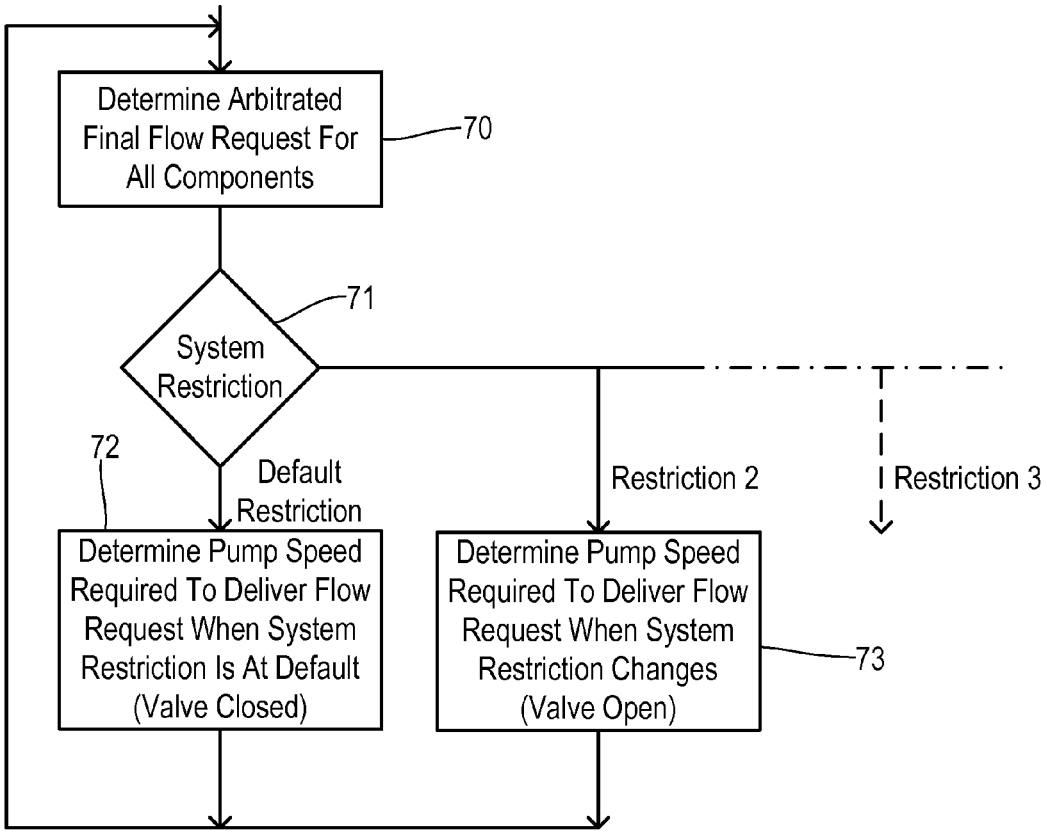
FIG. 7 is a flowchart showing how a method of the invention is expandable according to the distinct restriction states of any particular coolant loop.

Based on the number of distinct restriction states for a particular coolant loop apparatus, additional mapping tables or equivalent formulas are defined in advance FIG. 7 shows how the method of the invention is adaptable to coolant loops which may have various different restriction states. In step 70, the pump controller determines an arbitrated final flow meeting the requests of all components. Then the system restriction state is identified in step 71. In this example, the coolant loop has a heater core isolation valve as shown in FIG. 1. When the valve is closed, the coolant loop has a default restriction state. In step 72, the pump speed is determined which is required to deliver the flow request when in the default state (and that speed is used to control the pump). A second restriction state corresponds to the heater core isolation valve being open. In that case, the pump speed is determined which is required to deliver the flow request in step 73. In the event that another restriction state is possible (e.g., a restriction state #3), then the method includes additional steps where the desired flow rate is converted into a respective pump speed.

Figure 8:
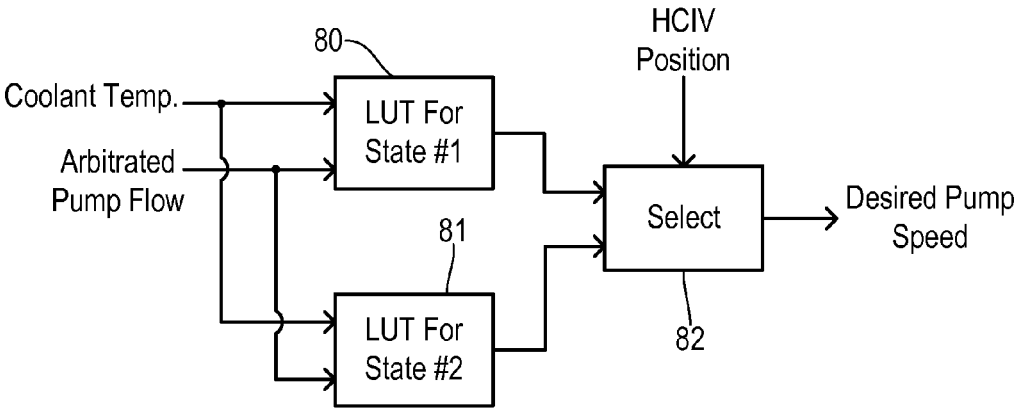
FIG. 8 is a block diagram showing a portion of a pump controller according to the present invention.

FIG. 8 shows one embodiment of a portion of the pump controller for determining pump speed. A first lookup table (LUT) 80 stores data correlating desired pump flow rates to required pump speed for a first restriction state. A second lookup table (LUT) 81 stores data correlating desired pump flow rates to required pump speed for a second restriction state. An arbitrated pump flow is coupled to LUTs 80 and 81 to generate respective pump speeds. A heat core isolation valve position signal (e.g., a command signal generated by the EATC) is coupled to a selection block which causes the pump speed matching the current restrictions state (i.e., the state of the isolation valve) to be output as the desired pump speed. The coolant temperature may be also input to LUTs 80 and 81 to identify the state of the thermostat since that may also to influence the restriction state. Each lookup table may thus depend on both a state of an isolation valve and on the state of the thermostat.

What is claimed is:

1. A vehicle apparatus comprising:

a variable-speed coolant pump for providing a coolant flow;

a plurality of heat-transfer nodes having respective heat-transfer devices coupled in a coolant loop with the pump, wherein each node comprises a respective controller that generates a node flow rate request based on an operating state of the node, and wherein the coolant loop is configurable to a plurality of restriction states; and a pump controller receiving the node flow rate requests, mapping each respective node flow request to a pump flow rate that would produce the respective pump node flow rate request, selecting a largest mapped pump flow rate, identifying a restriction state in which the coolant loop is configured, selecting a pump speed in response to the selected pump flow rate and the identified restriction state, and commanding operation of the pump to produce the selected pump speed.

2. The vehicle apparatus of claim 1 wherein one of the heat-transfer nodes is comprised of a heater core in series with an isolation valve for selectably shutting off coolant flow to the heater core in a first restriction state and coupling coolant flow to the heater core in a second restriction state, and wherein the pump controller stores respective mapping data for the first and second restriction states to correlate pump flow rate to pump speed.

3. The vehicle apparatus of claim 2 further comprising:

a radiator; and a thermostatic valve having open and closed positions for selectably coupling the radiator to the coolant loop;

wherein the pump speed selected by the pump controller is further dependent upon the open or closed position of the thermostatic valve.

4. The vehicle apparatus of claim 3 further comprising:

a temperature sensor for detecting a temperature of coolant within the coolant loop;

wherein the pump controller identifies the position of the thermostatic valve in response to a comparison of the detected temperature to a temperature threshold.

5. A method of controlling coolant flow rate provided by a variable-speed coolant pump in a coolant loop in a vehicle, the method comprising the steps of:

sending a node flow rate request from each of a plurality of heat-transfer node controllers to a pump controller based on an operating state of each of a plurality of respective heat-transfer devices at respective nodes;

mapping each respective node flow rate request to a pump flow rate that would produce the respective node flow rate request;

selecting a largest mapped pump flow rate;

detecting a restriction state of the coolant loop;

selecting a pump speed in response to the selected pump flow rate and the detected restriction state; and commanding operation of the pump to produce the selected pump speed.

6. The method of claim 5 wherein one of the heat-transfer nodes is comprised of a heater core in series with an isolation valve for selectably shutting off coolant flow to the heater core in a first restriction state and coupling coolant flow to the heater core in a second restriction state; and wherein the selecting of pump speed is responsive to respective mapping data for the first and second restriction states to correlate pump flow rate to pump speed.

7. The method of claim 6 wherein a thermostatic valve selectably couples a radiator to the coolant loop, and wherein the selecting of a pump speed is further dependent upon the open or closed position of the thermostatic valve.

8. An apparatus comprising:

a coolant pump;

a coolant loop having node controllers generating respective node flow rate requests and having a variable restriction; and a pump controller arbitrating the requests to determine a minimum pump flow rate that satisfies all the requests, identifying the variable restriction, selecting a pump speed in response to the arbitrated pump flow rate and the identified variable restriction, and commanding operation of the pump to produce the selected pump speed.

* * * * *